US008830284B2

(12) United States Patent
Tsuchihashi et al.

(10) Patent No.: US 8,830,284 B2
(45) Date of Patent: Sep. 9, 2014

(54) IMAGE ERASING APPARATUS AND IMAGE ERASING METHOD

(75) Inventors: Hiroyuki Tsuchihashi, Shizuoka (JP); Ken Iguchi, Shizuoka (JP); Isao Yahata, Shizuoka (JP); Hiroyuki Taguchi, Shizuoka (JP); Takahiro Kawaguchi, Shizuoka (JP); Hiroyuki Taki, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 811 days.

(21) Appl. No.: 12/817,067

(22) Filed: Jun. 16, 2010

(65) Prior Publication Data

US 2010/0321456 A1 Dec. 23, 2010

Related U.S. Application Data

(60) Provisional application No. 61/218,826, filed on Jun. 19, 2009, provisional application No. 61/226,635, filed on Jul. 17, 2009.

(51) Int. Cl.
*B41J 29/26* (2006.01)
*B41M 7/00* (2006.01)

(52) U.S. Cl.
CPC *B41M 7/00* (2013.01); *B41M 7/009* (2013.01)
USPC ..... 347/179

(58) Field of Classification Search
USPC ..... 347/171, 179; 400/120.01, 695
See application file for complete search history.

(56) References Cited

U.S. PATENT DOCUMENTS

2009/0103147 A1 4/2009 Murakami
2010/0323287 A1 * 12/2010 Yahata et al. ..... 430/19

* cited by examiner

*Primary Examiner* — Huan Tran
(74) *Attorney, Agent, or Firm* — Patterson & Sheridan, LLP

(57) ABSTRACT

An image erasing apparatus includes an inlet receiving recording mediums sheet by sheet, a door key limiting the opening of a security box, an overlap feed sensor sensing the overlap feed of the recording mediums, plural size sensors sensing the sizes of the recording mediums, a movable tray on which the recording mediums input from the inlet are placed, a recovery box disposed below the movable tray to recover the recording mediums, and a recording medium carrying mechanism carrying the recording mediums.

8 Claims, 4 Drawing Sheets

IMAGE ERASING APPARATUS AND IMAGE ERASING METHOD

CROSS-REFERENCE TO RELATED APPLICATIONS

This application is based upon and claims the benefit of priority from the prior the U.S. Patent Application Ser. No. 61/218,826, filed on Jun. 19, 2009, and the prior the U.S. Patent Application Ser. No. 61/226,635, filed on Jul. 17, 2009 and the entire contents of which are incorporated herein by reference.

FIELD

The present invention relates to an image erasing apparatus erasing an image of a recording medium on which the image is formed with erasable developer, and more particularly, an image erasing apparatus and an image erasing method with improved security.

BACKGROUND

In recent years, with the requirement for saving resources, an image forming apparatus forming an image with erasable developer and an image erasing apparatus were introduced. This image erasing apparatus erases an image by applying heat or light to a recording medium on which the erasable developer is present to erase the developer. Accordingly, the erased recording medium can be reused.

Here, there is a problem regarding the treatment of a secret document when an image is formed on the secret document by the image forming apparatus. Recording mediums from which images are erased are accumulated once in a recording medium supply device such as a sheet feeding cassette. The image erasing apparatus is supplied with recording mediums from the recording medium supply device sheet by sheet and erases an image by heat.

When the images are erased from plural sheets of secret documents and the sheets are accumulated in the same recording medium supply device as typical documents, the secret documents may be read by a third party before an image erasing process is started.

When the erasing of the images is not complete and the sheets are discharged to an accumulation unit of non-reusable recording mediums in the same path as typical documents, the secret documents may be read by a third party.

From this point of view, a technique of surrounding a part accessible by a third party with a barrier wall having an openable door, providing the door with a key having a sensor, and erasing an image when all the sensors indicate that the door is locked is disclosed.

DETAILED DESCRIPTION

Throughout this description, the embodiments and examples shown should be considered as exemplars, rather than limitations on the apparatus and methods of the present invention.

Hereinafter, an image erasing apparatus and an image erasing method according to an embodiment of the invention will be described in detail with reference to the accompanying drawings.

An image erasing apparatus erasing an image of a recording medium, includes: a stacking tray stacking the recording medium; a heater heating the recording medium to a temperature equal to or higher than the temperature at which developer on the recording medium is erased; a detector disposed downstream in a recording medium carrying direction from the heater to detect an image on the recording medium; an inlet receiving the recording medium sheet by sheet; a movable tray on which the recording medium input from the inlet is placed; a recovery box disposed below the movable tray to recover the recording medium; a door key limiting access to the movable tray and the recovery box; a recording medium carrying mechanism picking up the recording medium from the stacking tray and the movable tray sheet by sheet and carrying the picked-up recording medium; and a controller controlling the recording medium carrying mechanism to recover the recording medium to the recovery box when the detector detects a non-erased image on the recording medium picked up from the movable tray.

Configuration of Image Erasing Apparatus

Figure 1:
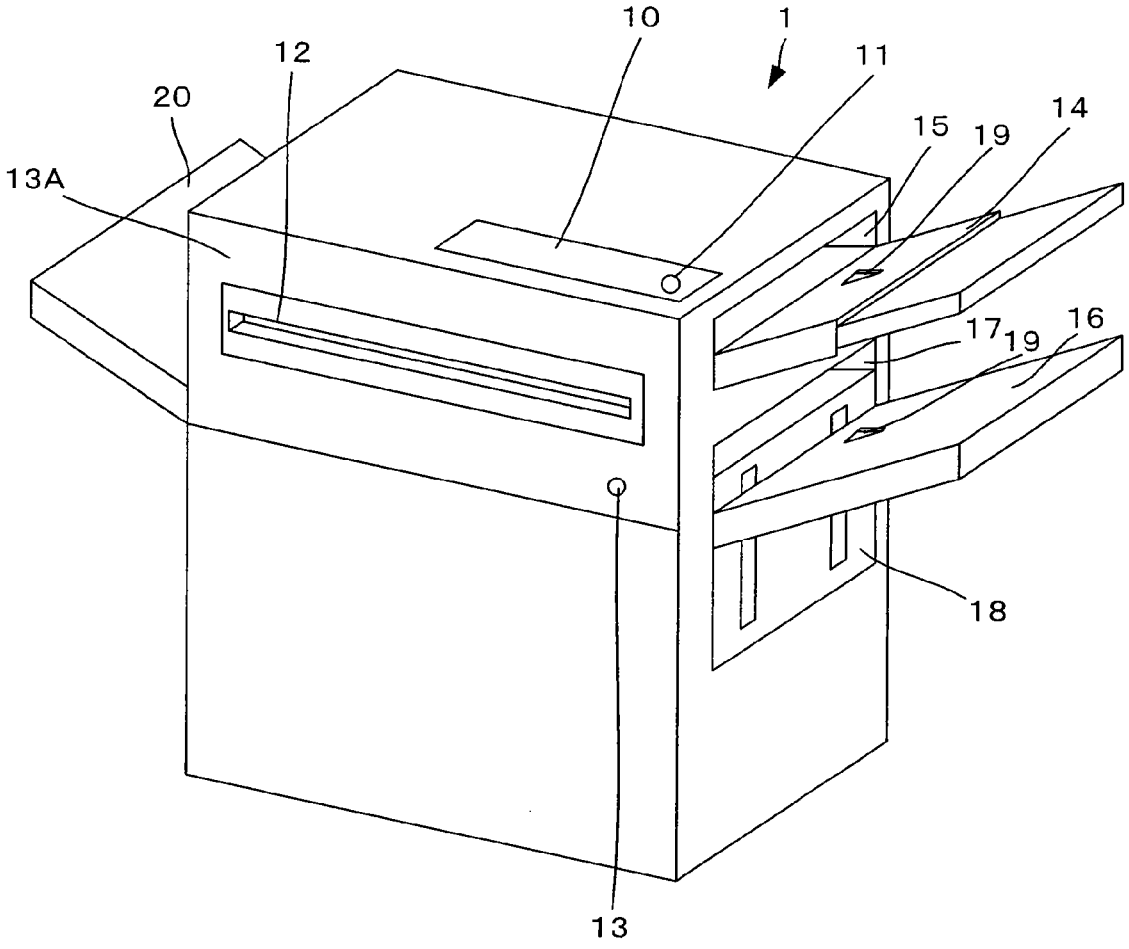
FIG. 1 is a perspective view illustrating an appearance of an image erasing apparatus according to an embodiment of the invention.

FIG. 1 is a perspective view illustrating the appearance of the image erasing apparatus 1. As shown in FIG. 1, the image erasing apparatus 1 includes a control panel 10 which is an input and output device on the top surface of a main body, a start button 11 for instructing the input of a secret document, an inlet 12 of a security box 30 to be described later, and a door key 13 limiting the opening of the security box 30.

The image erasing apparatus 1 further includes an interrupt tray 14 which is foldable, an interrupt reception port 15 receiving a recording medium from the interrupt tray 14, and a recording medium sensor 19 disposed on the top of the interrupt tray.

The image erasing apparatus 1 further includes a stacking tray 16 for stacking recording mediums from which images are erased, a recording medium sensor 19 disposed on the top surface of the stacking tray 16, a stacking tray lifting and lowering mechanism 18 lifting and lowering the stacking tray 16, and a reception port 17 for receiving a recording medium from the stacking tray 16.

The image erasing apparatus 1 further includes a sheet discharge tray 20 for stacking recording mediums from which images are erased.

The image erasing apparatus 1 receives, out of the recording mediums from which images are erased, a secret document from the inlet 12 receives normal documents stacked on the stacking tray 16 from the reception port 17, receives documents from which images should be erased by interrupt when erasing an image from the interrupt reception port 15, and discharges the recording mediums from which images cannot be erased to the sheet discharge tray 20.

Figure 2:
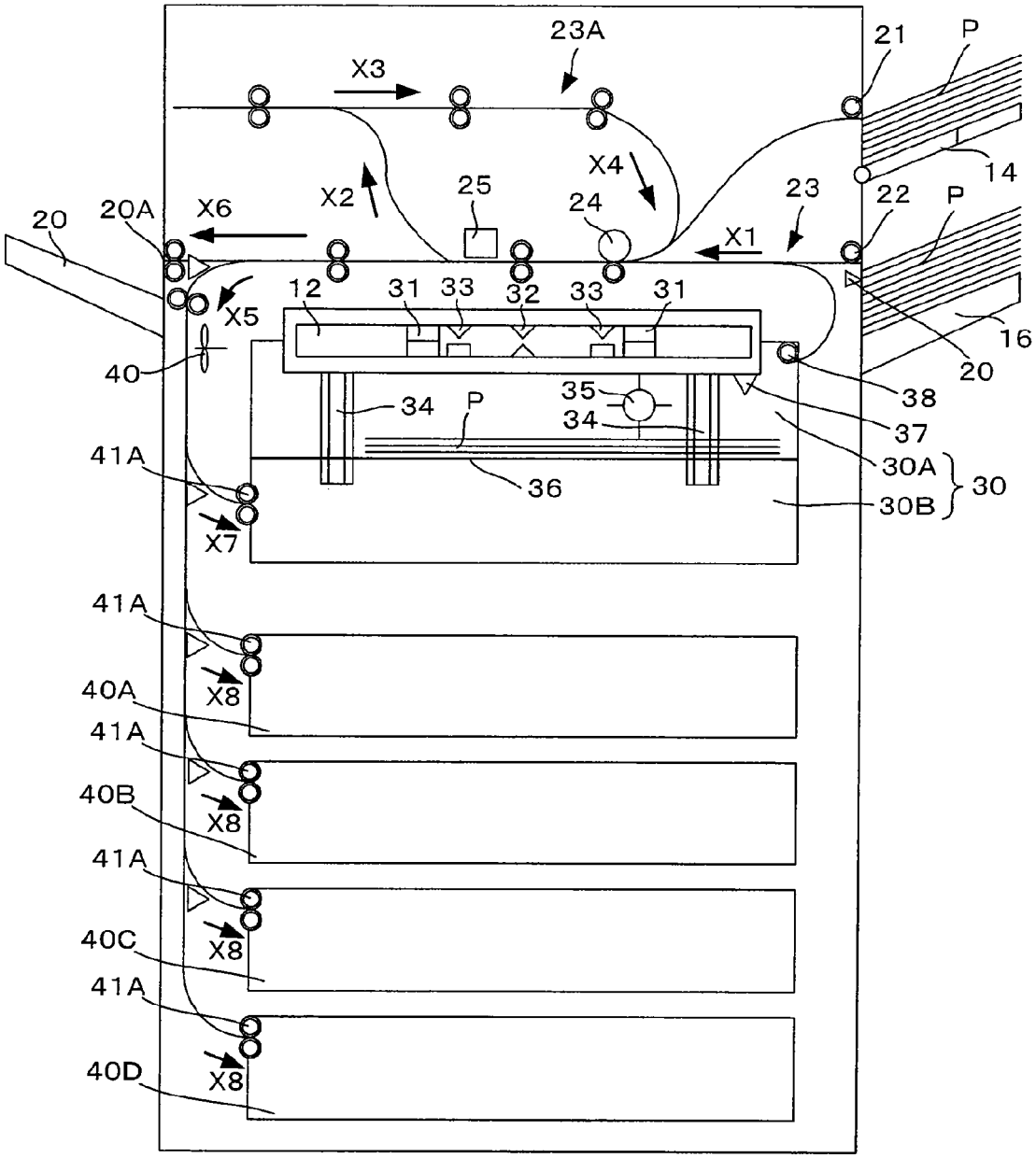
FIG. 2 is a side view illustrating a configuration of the image erasing apparatus according to the embodiment of the invention.

FIG. 2 is a side view illustrating the configuration of the image erasing apparatus 1. As shown in FIG. 2, the image erasing apparatus 1 includes a recording medium carrying mechanism 23 having an inverse carrying path 23A for inverting a recording medium, a thermal head 24 as a heater heating the recording medium at a temperature equal to or higher than the erasable temperature of the developer to be erased by heat, and a scanner 25 as a detector disposed downstream in the recording medium carrying direction from the thermal head 24 and configured to detect whether an image is erased from a recording medium.

The heat source of the heater is not particularly limited as long as it can heat a recording medium to a temperature equal to or higher than an erasing temperature. For example, a halogen heater, a graphite heater, an induction heater (IH), and a roller formed of a thermally-conductive material and having a heating lamp therein can be used as the heater. In this embodiment, the thermal head 24 is exemplified as the heater, but the heater is not limited to the thermal head 24.

In the image erasing apparatus 1, an interrupt reception port roller 21 for introducing a recording medium into the recording medium carrying mechanism is disposed in the interrupt reception port 15. In the image erasing apparatus 1, a reception port roller 22 for introducing a recording medium into the recording medium carrying mechanism and a top sensor 20 for sensing a top surface of a recording medium stacked on the stacking tray 16 are disposed in the reception port 17.

In the image erasing apparatus 1, an overlap feed sensor 32 sensing the overlap feed (double feed) of recording mediums, plural size sensors 33 sensing the size of a recording medium, and an inlet roller 31 introducing a recording medium into a security box 30 are disposed in the inlet 12.

For example, an ultrasonic sensor can be used as the overlap feed sensor 32. In the overlap feed sensor 32, an ultrasonic output device is disposed above the inlet 12 and an ultrasonic sensing device is disposed below the inlet, whereby it is sensed whether a sheet of recording medium is fed or plural sheets of recording mediums are fed on the basis of an ultrasonic wave sensed by the ultrasonic sensing device.

For example, optical sensors can be used as the size sensors 33. In each size sensor 33, a light-emitting device is disposed above the inlet 12 and a light-receiving device is disposed below the inlet, whereby the size of a recording medium is detected by causing the light-receiving device to sense the interception of light from the light-emitting device by the recording medium.

In the image erasing apparatus 1, a movable tray 36 on which a recording medium input from the inlet 12 is placed, a movable tray lifting and lowering mechanism 34 lifting and lowering the movable tray 36, an alignment paddle 35 aligning the recording mediums placed on the movable tray 36 in the recording medium carrying direction, a movable tray top sensor 37 sensing the top surface of a recording medium placed on the movable tray 36, and a pickup roller 38 picking up the recording mediums on the movable tray 36 sheet by sheet are disposed in the security box 30.

The movable tray lifting and lowering mechanism 34 includes a belt and a driving motor. The belt is rotated with the driving force of the driving motor to lift and lower the movable tray 36.

When the image erasing apparatus 1 receives an instruction to receive a recording medium from the inlet 12 from the start button 11, the movable tray 36 is lifted down and the alignment paddle 35 is rotated. When the reception of a recording medium is ended and an image is erased therefrom, the movable tray 36 is lifted up until the movable tray top sensor 37 senses the top surface of the recording medium, and the pickup roller 38 feeds the recording mediums to the recording medium carrying mechanism 23 sheet by sheet.

When the overlap feed sensor 32 senses the overlap feed of recording mediums or when the size sensors 33 sense the input of a recording medium having a size other than set target sizes, the image erasing apparatus 1 rotates the inlet roller 31 backwardly to discharge the recording medium and displays an error message on the control panel 10.

In the image erasing apparatus 1, the security box 30 is partitioned into an upper box 30A and a recovery box 30B by the use of the movable tray 36. That is, the image erasing apparatus 1 includes the recovery box 30B for storing recording mediums below the movable tray 36. The image erasing apparatus 1 includes an input roller 41A for inputting a recording medium into the recovery box 30B.

The door key 13 limits the access to the movable tray 36 and the recovery box 30B. That is, the movable tray 36 and the recovery box 30B are covered by the door 13A. The door 13A includes the door key 13. When the door key 13 is not opened, the door 13A is not opened, and thus the recording mediums in the movable tray 36 and the recovery box 30B cannot be taken out.

The image erasing apparatus 1 includes storage boxes 40A, 40B, 40C, and 40D for storing the recording mediums, from which images are erased, by sizes. Each of the storage boxes 40A, 40B, 40C, and 40D of the image erasing apparatus 1 includes the input roller 41A.

The image erasing apparatus 1 includes a cooling fan 40 as a cooler downstream in the recording medium carrying direction from the thermal head 24 and upstream in the recording medium carrying direction from the storage boxes 40A, 40B, 40C, and 40D.

The cooling fan 40 cools the developer with viscosity increased by heat, whereby the recording mediums are prevented from being attached to each other when the recording mediums are stored on the storage boxes 40A, 40B, 40C, and 40D.

Image Erasing Operation

The image erasing apparatus 1 receives a recording medium from the interrupt reception port 15, the reception port 17, or the pickup roller 38 and carries the received recording medium in the direction of arrow X1 by the use of the recording medium carrying mechanism 23. The thermal head 24 heats the recording medium to erase the developer. The heated recording medium is carried to the scanner 25. The scanner 25 scans the recording medium to sense an image.

When an image is sensed by the scanner 25 and the recording medium is a normal document received from the interrupt reception port 15 or the reception port 17, the image erasing apparatus 1 carries the recording medium in the direction of arrow X6 by the use of the recording medium carrying mechanism 23 and discharges the recording medium to the sheet discharge tray 20 from a discharge port 20A.

When an image is sensed by the scanner 25 and the recording medium is a secret document received from the pickup roller 38, the image erasing apparatus 1 carries the recording medium in the direction of arrow X7 by the use of the recording medium carrying mechanism 23 and recovers the recording medium into the recovery box 30B.

When an image is not sensed by the scanner 25, the image erasing apparatus 1 inverts the recording medium by the use of the inverse carrying path 23A. That is, the recording medium is carried in the order of arrow X2, arrow X3, and arrow X4, thereby inverting the recording medium.

The image erasing apparatus 1 heats the inverted recording medium by the use of the thermal head 24 to erase the developer. The heated recording medium is carried to the scanner 25. The scanner 25 scans the recording medium to sense an image.

When an image is sensed by the scanner 25 and the recording medium is a normal document received from the interrupt reception port 15 or the reception port 17, the image erasing apparatus 1 carries the recording medium in the direction of arrow X6 by the use of the recording medium carrying mechanism 23 and discharges the recording medium to the sheet discharge tray 20 from the discharge port 20A.

When an image is sensed by the scanner 25 and the recording medium is a secret document received from the pickup roller 38, the image erasing apparatus 1 carries the recording medium in the direction of arrow X7 by the use of the recording medium carrying mechanism 23 and recovers the recording medium into the recovery box 30B.

That is, when the scanner 25 senses a non-erased image from at least one of the top surface and the bottom surface of the recording medium picked up from the movable tray 36, the image erasing apparatus 1 controls the recording medium carrying mechanism 23 to recover the recording medium into the recovery box 30B.

When an image is not sensed by the scanner 25, the image erasing apparatus 1 carries the recording medium in the direction of arrow X8 and distributes the recording medium to the storage boxes 40A, 40B, 40C, and 40D depending on the size of the recording medium.

Interrupt Operation

The image erasing apparatus 1 stops the image erasing operation once, when the recording medium sensor 19 of the interrupt tray 14 senses that a recording medium is stacked on the interrupt tray 14.

Then, the image erasing apparatus 1 introduces the recording medium stacked on the interrupt tray 14 from the interrupt reception port 15 sheet by sheet and performs the image erasing operation.

When the recording medium sensor 19 of the interrupt tray 14 does not sense that a recording medium is stacked on the interrupt tray 14, the image erasing apparatus 1 receives the recording medium from the reception port 17 or the pickup roller 38 and restarts the image erasing operation.

Storage Box Aligning Mechanism

Figure 3:
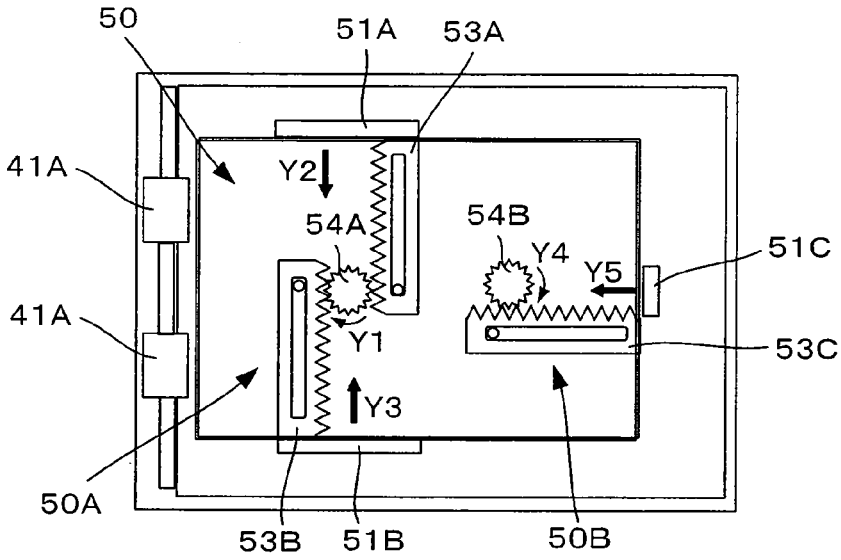
FIG. 3 is a top view of a storage box aligning mechanism according to the embodiment of the invention.
Figure 4:
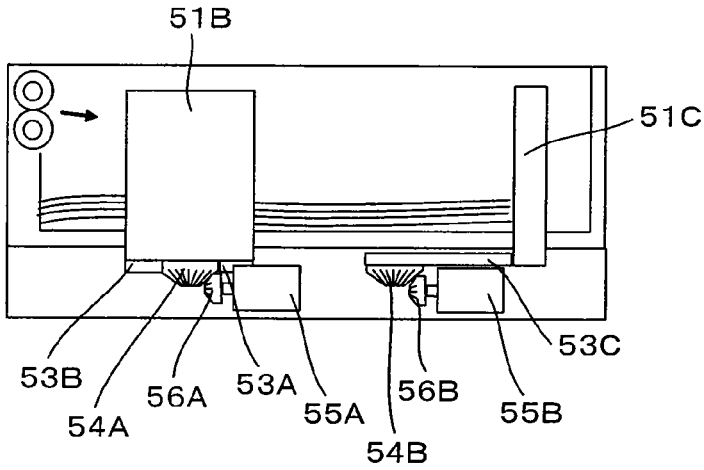
FIG. 4 is a side view of the storage box aligning mechanism according to the embodiment of the invention.

FIG. 3 is a top view illustrating the storage box aligning mechanism 50 which is disposed in the storage boxes 40A, 40B, 40C, and 40D. FIG. 4 is a side view of the storage box aligning mechanism 50.

As shown in FIGS. 3 and 4, the storage box aligning mechanism 50 includes a lateral aligning mechanism 50A aligning recording mediums in the lateral direction and a longitudinal aligning mechanism 50B aligning the recording mediums in the longitudinal direction.

The lateral aligning mechanism 50A includes a lateral aligning driving motor 55A having a gear 56A, a lateral aligning gear 54A, a first lateral aligning panel 51A connected to a first axial portion 53A having saw teeth engaging with the lateral aligning gear 54A, and a second lateral aligning panel 51B connected to a second axial portion 53B having saw teeth engaging with the lateral aligning gear 54A.

When the lateral aligning gear 54A rotates in the direction of arrow Y1, the first lateral aligning panel 51A is displaced in the direction of arrow Y2 and the second lateral aligning panel 51B is displaced in the direction of arrow Y3. In the image erasing apparatus 1, the first lateral aligning panel 51A and the second lateral aligning panel 51B are made to reciprocate by repeatedly rotating the lateral aligning gear 54A forwardly and backwardly a predetermined number of times, thereby aligning the stored recording mediums in the lateral direction.

The longitudinal aligning mechanism 50B includes a longitudinal aligning driving motor 55B having a gear 56B, a longitudinal aligning gear 54B, and a longitudinal aligning panel 51C connected to a third axial portion 53C having saw teeth engaging with the longitudinal aligning gear 54B.

When the longitudinal aligning gear 54B rotates in the direction of arrow Y4, the longitudinal aligning panel 51C is displaced in the direction of arrow Y5. The image erasing apparatus 1 causes the longitudinal aligning panel 51C to reciprocate by repeatedly rotating the longitudinal aligning gear 54B forwardly and backwardly a predetermined number of times, thereby aligning the stored recording mediums in the longitudinal direction.

Control System of Image Erasing Apparatus

Figure 5:
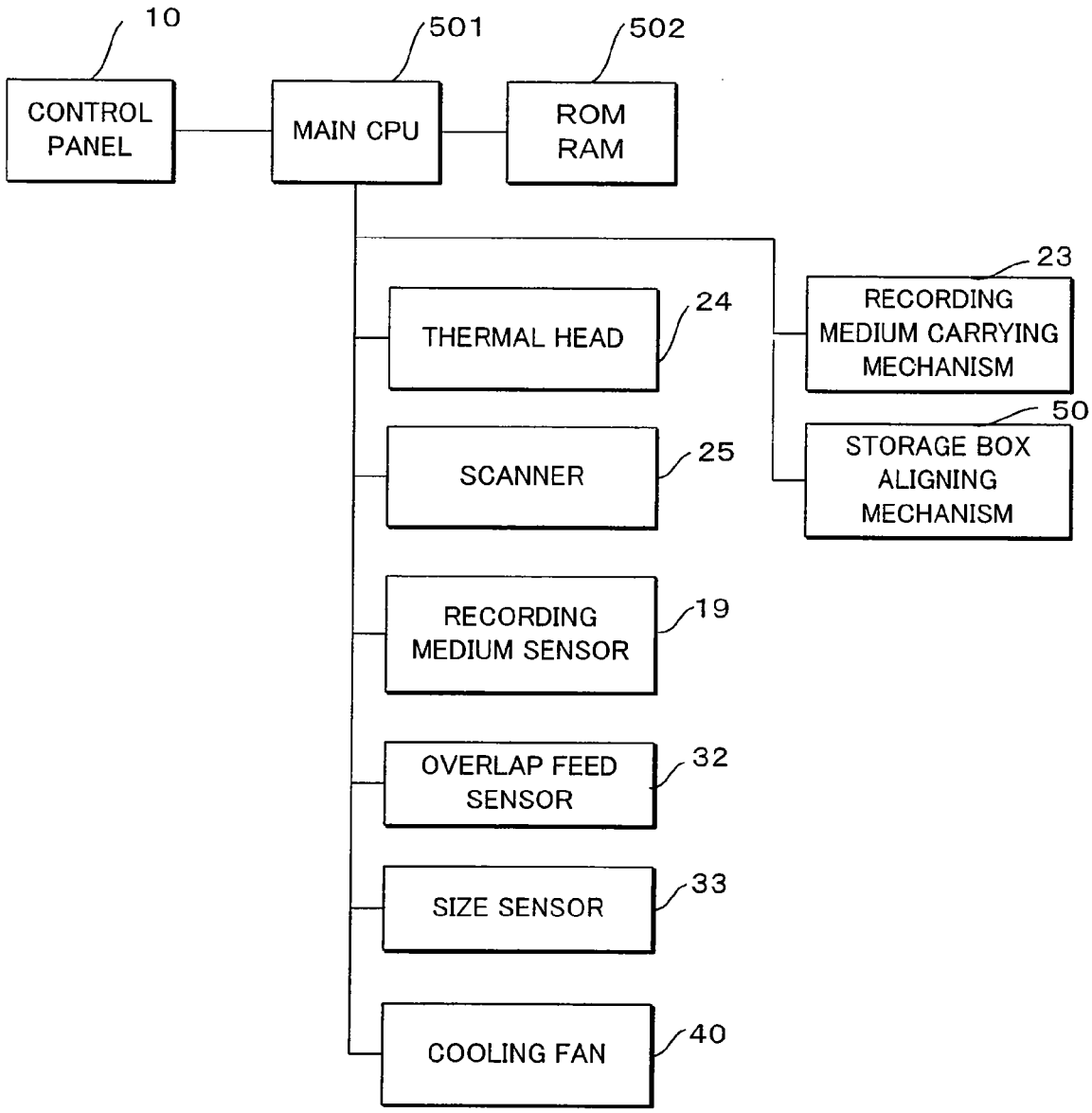
FIG. 5 is a block diagram illustrating a configuration of the image erasing apparatus according to the embodiment of the invention.

FIG. 5 is a block diagram illustrating the configuration of the image erasing apparatus 1. As shown in FIG. 5, the image erasing apparatus 1 includes a main CPU 501 as a controller. The main CPU 501 is connected to the control panel 10 and a ROM and RAM 502 as a memory device.

The main CPU 501 is also connected to the thermal head 24, the scanner 25, the recording medium sensor 19, the overlap feed sensor 32, the size sensors 33, and the cooling fan 40.

The main CPU 501 controls the recording medium carrying mechanism 23 and the storage box aligning mechanisms 50.

The main CPU 501 controls ON and OFF of the thermal head 24 and the temperature thereof. The main CPU 501 controls ON and OFF of the cooling fan 40 and the number of revolutions thereof.

Advantages

As described above, the image erasing apparatus 1 according to this embodiment includes the inlet 12 receiving recording mediums sheet by sheet, the door key 13 limiting the opening of the security box 30, the overlap feed sensor 32 sensing the overlap feed of the recording mediums, the plural size sensors 33 sensing the sizes of the recording mediums, the movable tray 36 on which the recording mediums input from the inlet 12 are placed, the recovery box 30B disposed below the movable tray 36 to recover the recording mediums, and the recording medium carrying mechanism 23 carrying the recording mediums.

Therefore, it becomes easy to additionally input a secret document and to guarantee the security by recovering the recording medium into the recovery box 30B even when the developer is not erased from the recording medium.

While certain embodiments have been described, these embodiments have been presented by way of example only, and are not intended to limit the scope of the inventions. Indeed, the novel methods and apparatuses described herein may be embodied in a variety of other forms; furthermore, various omissions, substitutions and changes in the form of the methods and systems described herein may be made without departing from the spirit of the inventions. The accompanying claims and their equivalents are indeed to cover such forms or modifications as would fall within the scope and spirit of the inventions.

What is claimed is:

1. An image erasing apparatus for erasing an image on a recording medium, comprising:

a recording medium supplying unit configured to supply the recording medium;

a conveying unit configured to convey the supplied recording medium;

an eraser configured to erase the image on the recording medium;

a detector disposed downstream in a recording medium conveying direction from the eraser and configured to detect an image remaining on the recording medium after erasing of the image by the eraser;

a first stacking unit disposed downstream in the recording medium conveying direction from the detector and configured to stack the recording medium;

a second stacking unit disposed downstream in the recording medium conveying direction from the detector and configured to stack the recording medium, the second stacking unit being different from the first stacking unit, the second stacking unit comprising a lock unit configured to restrict opening of the second stacking unit; and a controller configured to control the conveying unit to convey the recording medium to the first stacking unit if no remaining image on the erased recording medium is detected by the detector, and to convey the recording medium to the second stacking unit if a remaining image on the erased recording medium is detected by the detector.

2. The apparatus according to claim 1, further comprising a third stacking unit configured to stack the recording medium, wherein the controller is configured to control the conveying unit to convey the recording medium to the second stacking unit if the recording medium having the remaining image is part of a classified document, and to convey the recording medium to the third stacking unit if the recording medium having the remaining image is part of an unclassified document.

3. The apparatus according to claim 2, wherein the recording medium supplying unit comprises a first recording medium supplying unit and a second recording medium supplying unit, and the controller is configured to control the conveying unit to convey the recording medium to the third stacking unit if the recording medium having the remaining image was supplied from the first recording medium supplying unit, and to convey the recording medium to the second stacking unit if the recording medium having the remaining image was supplied from the second recording medium supplying unit.

4. The apparatus according to claim 3, wherein the first stacking unit is configured to stack the erased recording medium sorted by size.

5. The apparatus according to claim 3, wherein the eraser is configured to heat the recording medium to a temperature equal to or higher than a temperature at which developer on the recording medium is erased.

6. The apparatus according to claim 3, wherein the second recording medium supplying unit has a supply tray configured to stack the recording medium;

the second stacking unit is disposed under the supply tray; and the lock unit is configured to restrict access to the second recording medium supplying unit and the second stacking unit.

7. The apparatus according to claim 3, further comprising:

an interrupt tray comprising a recording medium sensor configured to detect a recording medium, wherein, if the controller detects a presence of the recording medium in the interrupt tray by way of the recording medium sensor, the controller causes erasing to stop immediately, feeding of the recording medium stacked in the interrupt tray one by one, and erasing of the image on each recording medium that is fed.

8. The apparatus according to claim 7, wherein, if the controller does not detect the presence of the recording medium in the interrupt tray by way of the recording medium sensor, the controller causes feeding of the recording medium from the recording medium supplying unit one by one, and erasing of the image on each recording medium that is fed.

* * * * *